US011227714B2

(12) United States Patent
Lee et al.

(10) Patent No.: US 11,227,714 B2
(45) Date of Patent: Jan. 18, 2022

(54) COIL COMPONENT AND METHOD OF MANUFACTURING THE SAME

(71) Applicant: SAMSUNG ELECTRO-MECHANICS CO., LTD., Suwon-si (KR)

(72) Inventors: Yoon Hee Lee, Suwon-si (KR); Bon Seok Koo, Suwon-si (KR); Yeon Tae Kim, Suwon-si (KR); Chang Hak Choi, Suwon-si (KR); Jung Min Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 147 days.

(21) Appl. No.: 16/743,917

(22) Filed: Jan. 15, 2020

(65) Prior Publication Data

US 2020/0168388 A1 May 28, 2020

Related U.S. Application Data

(62) Division of application No. 15/472,700, filed on Mar. 29, 2017, now Pat. No. 10,580,567.

(30) Foreign Application Priority Data

Jul. 26, 2016 (KR) ..... 10-2016-0094705
Nov. 16, 2016 (KR) ..... 10-2016-0152722
Dec. 21, 2016 (KR) ..... 10-2016-0176097

(51) Int. Cl.
*H01F 5/00* (2006.01)
*H01F 27/28* (2006.01)
(Continued)

(52) U.S. Cl.
CPC ..... *H01F 27/2804* (2013.01); *H01F 17/0013* (2013.01); *H01F 27/292* (2013.01);
(Continued)

(58) Field of Classification Search
USPC ..... 336/200, 232, 83
See application file for complete search history.

(56) References Cited

U.S. PATENT DOCUMENTS 8,222,751 B2 7/2012 Nomura et al.
8,988,850 B1 3/2015 Kodama et al.
(Continued)

FOREIGN PATENT DOCUMENTS

CN 1723514 A 1/2006
CN 101429322 A 5/2009
(Continued)

OTHER PUBLICATIONS

Second Office Action issued in corresponding Chinese Patent Application No. 201710363055.2 dated Oct. 25, 2019, with English translation.
(Continued)

*Primary Examiner* — Shawki S Ismail
*Assistant Examiner* — Kazi S Hossain
(74) *Attorney, Agent, or Firm* — Morgan, Lewis & Bockius LLP

(57) ABSTRACT

A coil component includes: a body including a magnetic material and a coil of which both ends are externally exposed; intermetallic compounds disposed on the exposed both ends of the coil; and external electrodes disposed on the body to cover the intermetallic compounds. The external electrodes include: conductive resin layers disposed on outer surfaces of the body to contact the exposed both ends of the coil and including base resins, a plurality of metal particles disposed in the base resins, and conductive connecting parts
(Continued)

surrounding the plurality of metal particles and contacting the intermetallic compounds. The coil component further includes electrode layers disposed on the conductive resin layers and contacting the conductive connecting parts.

23 Claims, 11 Drawing Sheets

(51) Int. Cl.

| | |
|---|---|
| ***H01F 17/00*** | (2006.01) |
| ***H01F 27/29*** | (2006.01) |
| ***H01F 27/32*** | (2006.01) |
| ***H01F 41/04*** | (2006.01) |
| ***H01F 41/12*** | (2006.01) |

(52) U.S. Cl.
CPC ..... *H01F 27/323* (2013.01); *H01F 41/041* (2013.01); *H01F 41/122* (2013.01); *H01F 2027/2809* (2013.01)

(56) References Cited

U.S. PATENT DOCUMENTS

| | | | | |
|---|---|---|---|---|
| 9,881,737 | B2 | 1/2018 | Otani | |
| 2005/0012200 | A1 | 1/2005 | Sawada et al. | |
| 2005/0083637 | A1 | 4/2005 | Yoshii et al. | |
| 2005/0222300 | A1 | 10/2005 | Ikezawa et al. | |
| 2006/0044098 | A1 | 3/2006 | Kimura et al. | |
| 2009/0155608 | A1 | 6/2009 | Nomura et al. | |
| 2012/0168206 | A1 | 7/2012 | Sekine | |
| 2013/0027168 | A1 | 1/2013 | Kim et al. | |
| 2013/0249664 | A1 | 9/2013 | Tonoyama et al. | |
| 2013/0293334 | A1 | 11/2013 | Shin | |
| 2014/0110153 | A1* | 4/2014 | Kashiwagi | C22C 30/02 174/251 |
| 2014/0204502 | A1 | 7/2014 | Chun et al. | |
| 2015/0136463 | A1 | 5/2015 | Lee et al. | |
| 2015/0279563 | A1 | 10/2015 | Otani | |
| 2016/0035476 | A1* | 2/2016 | Mimura | H01F 17/0006 336/199 |
| 2016/0042857 | A1 | 2/2016 | Chun et al. | |
| 2016/0126004 | A1 | 5/2016 | Yang et al. | |
| 2017/0178811 | A1 | 6/2017 | Chun et al. | |

FOREIGN PATENT DOCUMENTS

| | | | |
|---|---|---|---|
| CN | 101506906 | A | 8/2009 |
| CN | 102915826 | A | 2/2013 |
| CN | 103383886 | A | 11/2013 |
| CN | 104576052 | A | 4/2015 |
| CN | 104810124 | A | 7/2015 |
| CN | 104871271 | A | 8/2015 |
| JP | S56-67910 | A | 6/1981 |
| JP | WO2004/053901 | A1 | 6/2004 |
| JP | 2005-051226 | A | 2/2005 |
| JP | WO2008/026517 | A1 | 3/2008 |
| JP | 2012-044190 | A | 3/2012 |
| JP | 2013-069713 | A | 4/2013 |
| JP | 2013-161872 | A | 8/2013 |
| JP | 5390408 | B2 | 1/2014 |
| JP | WO2014/097822 | A1 | 6/2014 |
| JP | 2016-092404 | A | 5/2016 |
| KR | 10-2010-0110891 | A | 10/2010 |
| KR | 10-1214731 | B1 | 12/2012 |
| KR | 10-1474168 | B1 | 12/2014 |
| KR | 10-2015-0086343 | A | 7/2015 |
| KR | 10-2016-0019266 | A | 2/2016 |

OTHER PUBLICATIONS

Office Action issued in corresponding Japanese Patent Application No. 2017-077071 dated Oct. 30, 2018, with English translation.

Office Action issued in corresponding Chinese Patent Application No. 201710363055.2 dated Jun. 4, 2019, with English translation.

Office Action issued in corresponding Korean Patent Application No. 10-2016-0176097 dated Mar. 14, 2018, with English translation.

Office Action issued in corresponding Korean Patent Application No. 10-2016-0152722 dated Mar. 15, 2018, with English translation.

Notice of Allowance issued in corresponding U.S. Appl. No. 15/472,700 dated Oct. 18, 2019.

Office Action issued in corresponding U.S. Appl. No. 15/472,700 dated Aug. 5, 2019.

Office Action issued in corresponding Chinese Patent Application No. 202011251225.6 dated Nov. 18, 2021, with English translation.

* cited by examiner

COIL COMPONENT AND METHOD OF MANUFACTURING THE SAME

CROSS-REFERENCE TO RELATED APPLICATION(S)

This application is the divisional application of U.S. patent application Ser. No. 15/472,700 filed on Mar. 29, 2017, which claims benefit of priority to Korean Patent Application No. 10-2016-0094705 filed on Jul. 26, 2016, Korean Patent Application No. 10-2016-0152722 filed on Nov. 16, 2016 and Korean Patent Application No. 10-2016-0176097 filed on Dec. 21, 2016 in the Korean Intellectual Property Office, the disclosures of which are incorporated herein by reference in their entirety.

TECHNICAL FIELD

The present disclosure relates to a coil component and a method of manufacturing the same.

BACKGROUND

A power management integrated chip (PMIC) is used in order to increase a driving time in a mobile apparatus or a device equipment operated by a battery.

For example, when an interface signal is provided to the PMIC, depending on a load that should be processed in a central processing unit (CPU) or the like, the PMIC adjusts a core voltage supplied to the CPU depending on the interface signal to allow the equipment to be always driven by as low a power as possible.

A coil component used in the PMIC requires characteristics such as a high current and low direct current (DC) resistance (Rdc).

In a coil component according to the related art, external electrodes include one of metals such as silver, copper, and nickel, and a resin such as epoxy.

In addition, conductive metal particles are covered with a non-conductive resin, such that contact resistance is high, and the external electrodes contact internal electrodes formed of a metal by a resin without being separately coupled to the internal electrodes, such that bonding strength between the external electrodes and the internal electrodes is low.

Therefore, it is difficult to sufficiently secure reliability with respect to external impact, such as thermal impact or the like.

In addition, in the case of coil components, the internal electrodes are formed of a coil, and in accordance with the current miniaturization of an apparatus, an area of the coil exposed to the outside of a body may be decreased, such that many contact defects are generated.

SUMMARY

An aspect of the present disclosure may provide a coil component of which direct current (DC) resistance (Rdc) may be decreased by improving conductivity of an external electrode and improving electrical and mechanical bonding force between a coil and a conductive resin layer, and a method of manufacturing the same.

According to an aspect of the present disclosure, a coil component may include: a body including a coil, of which both ends are externally exposed; intermetallic compounds disposed on the exposed both ends of the coil; and external electrodes disposed on the body to cover the intermetallic compounds. The external electrodes include: conductive resin layers disposed on outer surfaces of the body, to be bonded to the exposed both ends of the coil and including base resins, a plurality of metal particles disposed in the base resins, and conductive connecting parts surrounding the plurality of metal particles and contacting the intermetallic compounds. The coil component further may include electrode layers disposed on the conductive resin layers and contacting the conductive connecting parts.

According to another aspect of the present disclosure, a method of manufacturing a coil component may include: forming a body including magnetic layers and a coil including a plurality of conductor patterns; applying a conductive resin composite onto one surface of the body to be electrically connected to one end of the coil, the conductive resin composite including metal particles, a thermosetting resin, and a low melting point metal, having a melting point lower than a hardening temperature of the thermosetting resin; forming a conductive resin layer so that a melted low melting point metal becomes a conductive connecting part surrounding the metal particles and an intermetallic compound is formed between an exposed surface of the coil and the conductive connecting part by hardening the conductive resin composite; and forming an electrode layer on the conductive resin layer by plating.

The forming of the conductive resin layer may include: removing oxide films on surfaces of metal particles and low melting point metal particles included in the thermosetting resin; and forming the conductive connecting part by a reaction between the metal particles, from which the oxide films are removed, and the low melting point metal particles, from which the oxide films are removed, and forming the intermetallic compound contacting the exposed surface of the coil by allowing the low melting point metal particles having flowability to flow into the region including and surrounding the exposed surface of the coil.

BRIEF DESCRIPTION OF DRAWINGS

The above and other aspects, features, and advantages of the present disclosure will be more clearly understood from the following detailed description when taken in conjunction with the accompanying drawings, in which.

DETAILED DESCRIPTION

Hereinafter, exemplary embodiments of the present disclosure will be described in detail with reference to the accompanying drawings.

Multilayer Inductor

Hereinafter, a multilayer inductor will be described as an example of a coil component according to an exemplary embodiment in the present disclosure. However, the coil component according to an exemplary embodiment in the present disclosure is not limited thereto.

Figure 1:
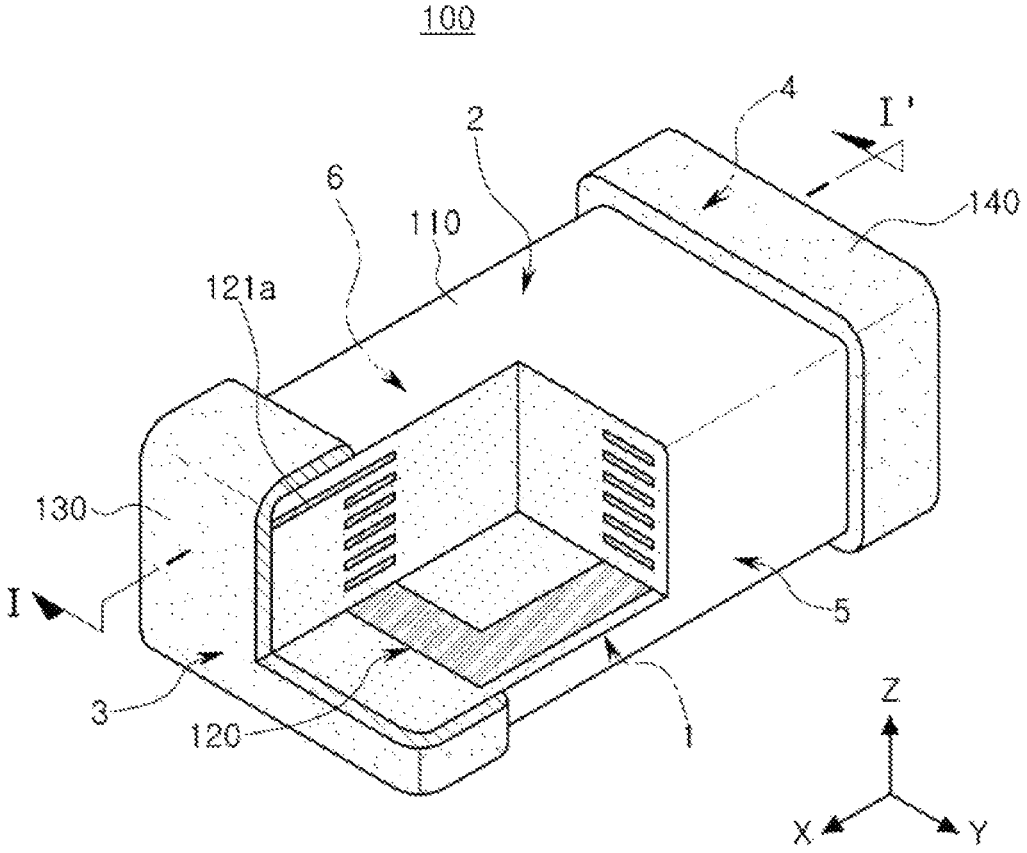
FIG. 1 is a schematic, partially cut-away perspective view illustrating an inductor according to an exemplary embodiment in the present disclosure.
Figure 2:
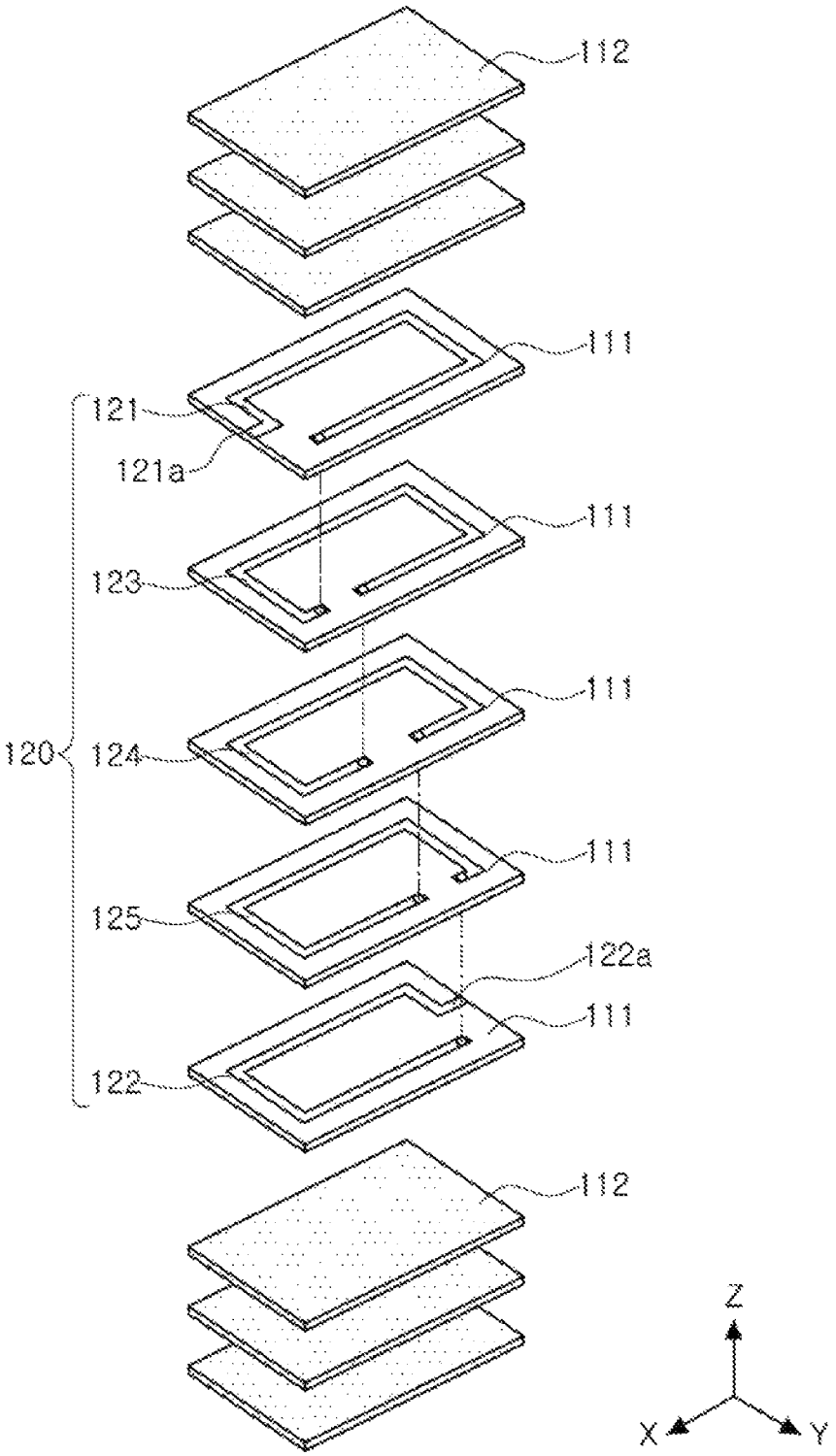
FIG. 2 is an exploded perspective view of the inductor of FIG. 1, from which external electrodes are removed.
Figure 3:
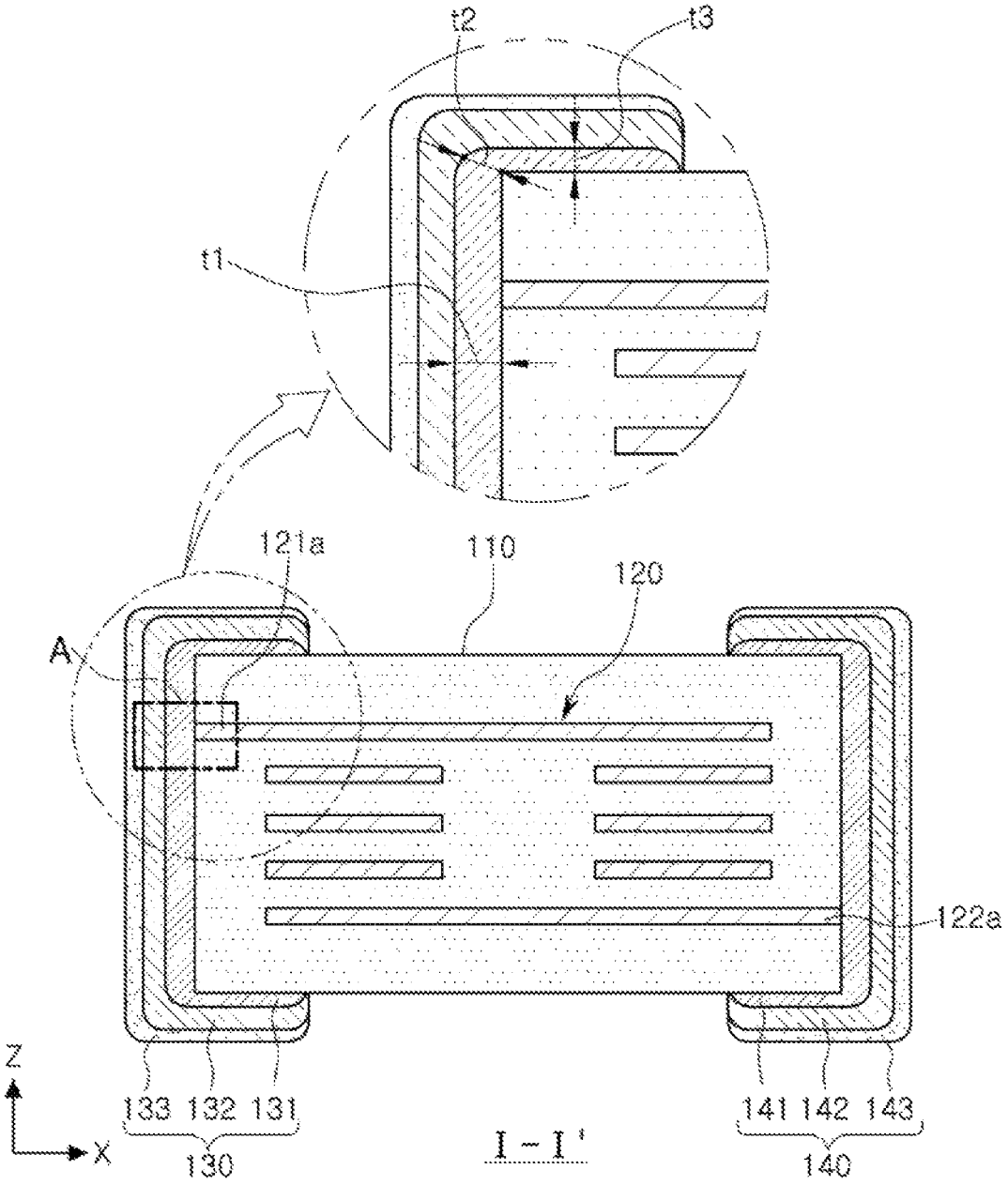
FIG. 3 is a cross-sectional view taken along line I-I' of FIG. 1.
Figure 4:
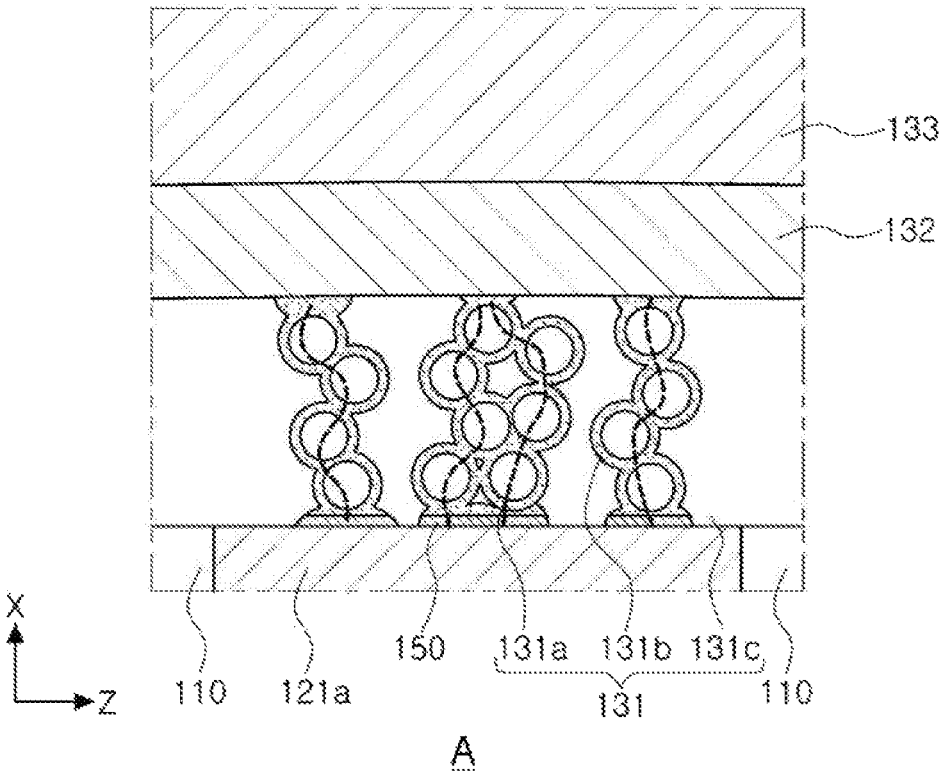
FIG. 4 is an enlarged cross-sectional view of region A of FIG. 3.

FIG. 1 is a schematic partially cut-away perspective view illustrating an inductor according to an exemplary embodiment in the present disclosure, FIG. 2 is an exploded perspective view of the inductor of FIG. 1 from which external electrodes are removed, FIG. 3 is a cross-sectional view taken along line I-I' of FIG. 1, and FIG. 4 is an enlarged cross-sectional view of region A of FIG. 3.

Referring to FIGS. 1 through 4, an inductor 100 according to an exemplary embodiment in the present disclosure may include a body 110, intermetallic compounds 150, and first and second external electrodes 130 and 140.

The body 110 may include a coil of which both ends are externally exposed.

A shape of the body 110 is not particularly limited, but may be substantially a hexahedral shape.

Directions of a hexahedron will be defined in order to clearly describe exemplary embodiments in the present disclosure. X, Y and Z in the drawings refer to a length direction, a width direction, and a thickness direction, respectively.

In addition, for convenience of explanation, first and second surfaces 1 and 2 of the body 110 refer to both surfaces of the body 110 opposing each other in a Z direction, third and fourth surfaces 3 and 4 of the body 110 refer to both surfaces of the body 110 opposing each other in an X direction and connecting front ends of the first and second surfaces 1 and 2 to each other, and fifth and sixth surfaces 5 and 6 of the body 110 refer to both surfaces of the body 110 opposing each other in a Y direction, connecting front ends of the first and second surfaces 1 and 2 to each other, and connecting front ends of the third and fourth surfaces 3 and 4 to each other.

In addition, a case in which the body 110 is formed of a magnetic material will be described below for convenience of explanation. However, a material of the body 110 according to an exemplary embodiment in the present disclosure is not limited to the magnetic material, but may also be a dielectric material such as ceramic.

The coil 120 according to the present exemplary embodiment may include a plurality of conductor patterns 121 to 125 stacked in the Z direction and a plurality of via electrodes (not illustrated) connecting adjacent conductive patterns 121 to 125 to each other.

The conductor patterns 121 to 125 may be formed by printing a conductive paste including a conductive metal at a predetermined thickness on magnetic layers, ceramic layers, or polymer substrates 111 or performing plating, or the like.

For example, the conductive metal may be a conductive metal such as silver (Ag), copper (Cu), nickel (Ni), and the like, or alloys thereof.

Among the conductor patterns, conductor patterns 121 and 122 disposed at upper and lower ends, respectively, may have first and second lead portions 121*a* and 122*a* disposed at both ends thereof, respectively.

The first and second lead portions 121*a* and 122*a* may be exposed through the third and fourth surfaces 3 and 4 of the body 110, respectively, and may have the intermetallic compounds 150 formed thereon, respectively.

Meanwhile, a portion surrounding the coil 120 may be formed of a metal magnetic material or a ferrite material, but is not limited thereto.

The intermetallic compounds 150 may be disposed to contact exposed portions of the first and second lead portions 121*a* and 122*a* of the coil 120 exposed to the third and fourth surfaces 3 and 4 of the body 110, respectively.

Here, in a case in which the coil 120 is formed of copper, the intermetallic compound 150 may be formed of copper-tin.

The intermetallic compound 150 may have a form of a plurality of islands, if necessary, and the plurality of islands may have a layer form.

The first and second external electrodes 130 and 140 may be disposed on the third and fourth surfaces 3 and 4 of the body 110, respectively, may cover the intermetallic compounds 150, respectively, and may be connected to the exposed portions of the first and second lead portions 121*a* and 122*a* of the coil 120, respectively.

The first and second external electrodes 130 and 140 may include conductive resin layers 131 and 141 disposed on outer surfaces of the body 110, and electrode layers 132 and 133 and 142 and 143 disposed on the conductive resin layers 131 and 141, respectively.

The conductive resin layers 131 and 141 may be disposed on the third and fourth surfaces 3 and 4 of the body 110, respectively, and may contact the exposed portions of the first and second lead portions 121*a* and 122*a* of the coil 120, respectively.

The conductive resin layers 131 and 141 may include base resins 131*c* and 141*c*, metal particles 131*a* and 141*a*, and conductive connecting parts 131*b* and 141*b*, respectively.

A plurality of metal particles 131*a* and 141*a* may be disposed in the base resins 131*c* and 141*c*, respectively, and the conductive connecting parts 131*b* and 141*b* may surround the plurality of metal particles 131*a* and 141*a*, respectively, and contact the intermetallic compounds 150 and the electrode layers 132 and 142, respectively.

FIG. 4 is an enlarged cross-sectional view of region A of FIG. 3.

Although an enlarged view of a portion of the first external electrode 130 is illustrated in the region A, configurations of the first and second external electrodes 130 and 140 may be similar to each other except that the first external electrode 130 is electrically connected to the first lead portion 121*a* of the coil 120 and the second external electrode 140 is electrically connected to the second lead portion 122*a* of the coil 120.

Therefore, a description will hereinafter be provided in relation to the first external electrode 130, but may be considered as including a description for the second external electrode 140, as well.

As illustrated in FIG. 4, the conductive resin layer 131 may be disposed on the third surface 3 of the body 110.

The conductive resin layer 131 may include the base resin 131*c*, the plurality of metal particles 131*a* disposed to be dispersed in the base resin 131*c*, and the conductive connecting part 131*b* surrounding the plurality of metal particles 131*a* and contacting the intermetallic compound 150.

The conductive resin layer 131 may have a form in which the plurality of metal particles 131*a* are dispersed in the base resin 131*c*.

In this case, a paste in which metal particles are dispersed in a resin may be used as an example of a material that may obtain the conductive resin layer 131, and since, in a case of applying the paste, the conductive resin layer 131 is formed through processes of drying and hardening an applied paste, the metal particles are not melted, such that the metal particles may be present in a particle form in the conductive resin layer 131, unlike a method of forming an external electrode by firing according to the related art.

In this case, the metal particles 131*a* may include at least one selected from the group consisting of nickel (Ni), silver (Ag), copper (Cu) coated with silver, copper coated with tin (Sn), and copper.

Meanwhile, in a case in which the metal particles 131*a* react to both low melting point metals forming the conductive connecting part 131*b* and the intermetallic compound 150, the metal particles 131*a* may not be present in the conductive resin layer 131.

However, for convenience of explanation, a case in which the metal particles 131*a* are included in the conductive resin layer 131 will hereinafter be illustrated and described in the present exemplary embodiment.

Figure 5:
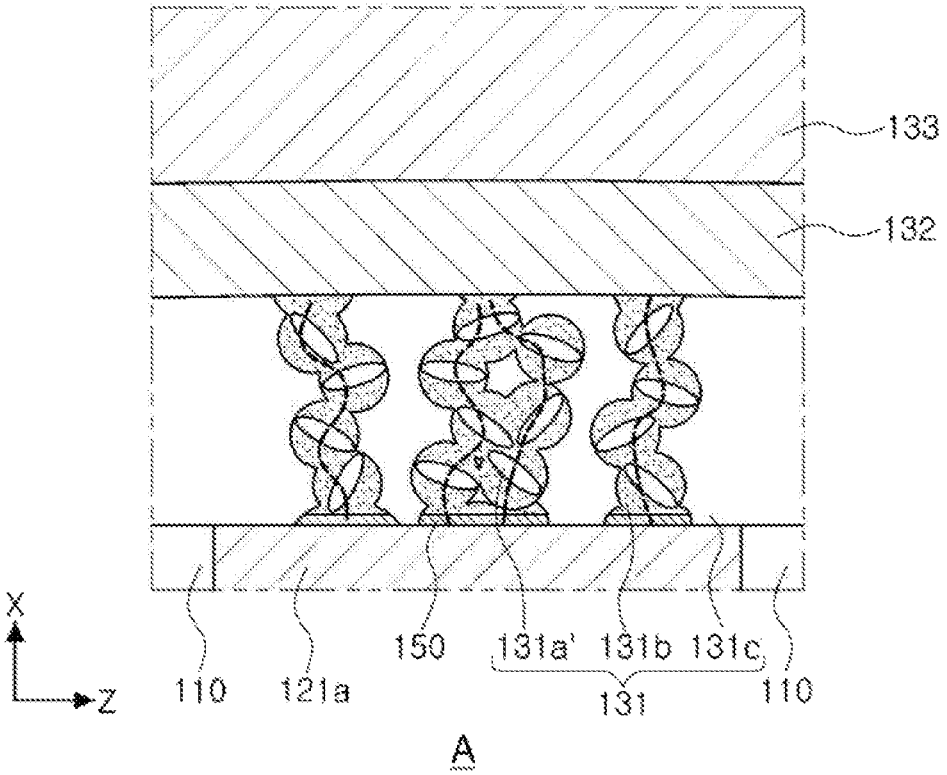
FIG. 5 is a cross-sectional view of region A of FIG. 3 illustrating metal particles having flake shapes.
Figure 6:
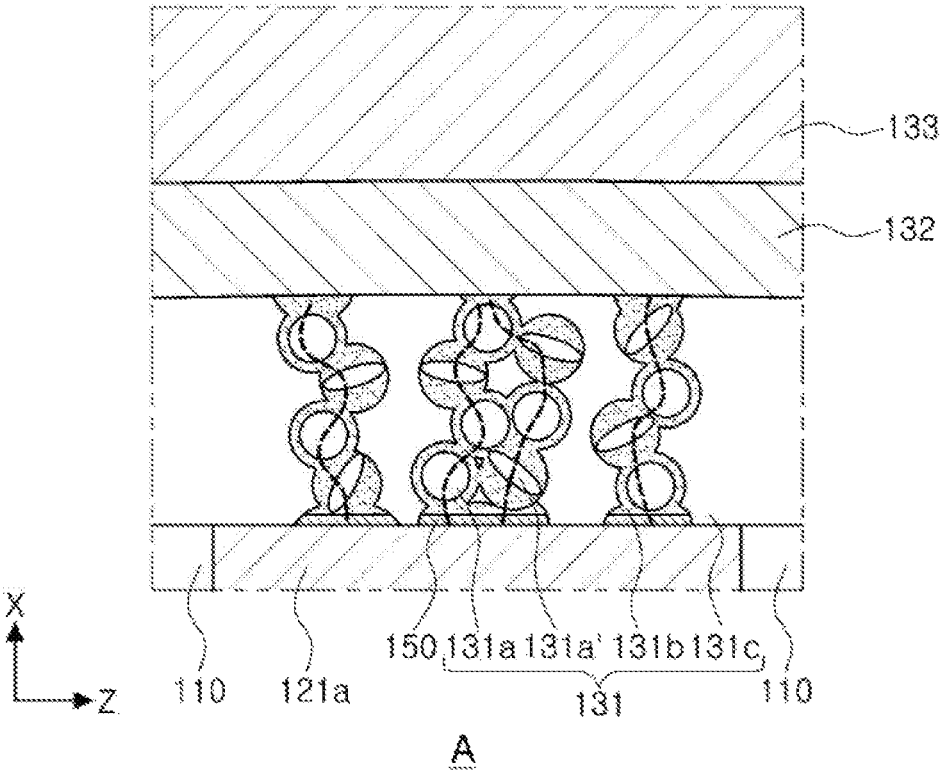
FIG. 6 is a cross-sectional view of region A of FIG. 3 illustrating mixtures of metal particles having spherical shapes and metal particles having flake shapes.

Meanwhile, the metal particles included in the conductive resin layer 131 may be only metal particles having spherical shapes, may be only metal particles 131*a*', having flake shapes, if necessary, as illustrated in FIG. 5, or may be mixtures of metal particles 131*a* having spherical shapes and metal particles 131*a*' having flake shapes, as illustrated in FIG. 6.

The conductive connecting part 131*b* may surround the plurality of metal particles 131*a* in a melted state to serve to connect the plurality of metal particles 131*a* to one another, thereby significantly decreasing internal stress of the body 110 and improving high temperature load and moisture resistance load characteristics.

The conductive connecting part 131*b* may serve to increase electrical conductivity of the conductive resin layer, 131 to decrease resistance of the conductive resin layer 131.

Here, in a case in which the metal particles 131*a* are included in the conductive resin layer 131, the conductive connecting part 131*b* may serve to increase connectivity between the metal particles 131*a*, to further decrease the resistance of the conductive resin layer 131.

In addition, a low melting point metal included in the conductive connecting part 131*b* may have a melting point lower than a hardening temperature of the base resin 131*c*.

In this case, the low melting point metal included in the conductive connecting part 131*b* may have a melting point of 300° C. or less.

In detail, the metal included in the conductive connecting part 131*b* may be an alloy of two or more selected from the group consisting of tin (Sn), lead (Pb), indium (In), copper (Cu), silver (Ag), and bismuth (Bi).

Here, in the case in which the metal particles 131*a* are included in the conductive resin layer 131, the conductive connecting part 131*b* may surround the plurality of metal particles 131*a* in the melted state to serve to connect the plurality of metal particles 131*a* to one another.

That is, since the low melting point metal included in the conductive connecting part 131*b* has the melting point lower than the hardening temperature of the base resin 131*c*, the low melting point metal may be melted in drying and hardening processes, and the conductive connecting part 131*b* may cover the metal particles 131*a* in the melted state, as illustrated in FIG. 4.

The conductive resin layer 131 may be formed by manufacturing a low melting point solder resin paste and then dipping the body in the low melting point solder resin paste. In a case in which silver or a metal coated with silver is used as a material of the metal particle 131*a* at the time of manufacturing the low melting point solder resin paste, the conductive connecting part 131*b* may include $Ag_3Sn$.

In this case, an internal electrode may include Cu, and the intermetallic compound 150 may include Cu—Sn.

When a paste in which the metal particles are dispersed is used as an electrode material, a flow of electrons is smooth in a case of a contact between metals, but may be rapidly decreased in a case in which a base resin surrounds the metal particles.

In order to solve this problem, an amount of the base resin may be significantly decreased and an amount of the metal may be increased to increase a contact ratio between the metal particles, thereby improving conductivity. However, in this case, sticking strength of the external electrode may be decreased due to the decrease in the amount of the base resin.

In the present exemplary embodiment, even though an amount of thermosetting resin is not extremely reduced, the contact ratio between the metal particles may be increased by the conductive connecting part, such that the sticking strength of the external electrode may not be decreased and electrical conductivity of the conductive resin layer may be improved. Therefore, direct current (DC) resistance (Rdc) of the inductor may be decreased.

The intermetallic compound 150 may be disposed on a distal end of the first lead portion 121*a* of the coil 120, and may contact the conductive connecting part 131*b* to serve to connect the first lead portion 121*a* and the conductive connecting part 131*b* to each other.

Therefore, the intermetallic compound 150 may serve to improve electrical and mechanical bonding between the conductive resin layer 131 and the coil 120, to decrease contact resistance between the conductive resin layer 131 and the coil 120.

The intermetallic compound 150 may be formed of one of copper-tin (Cu—Sn), silver-tin (Ag—Sn), and nickel-tin (Ni—Sn).

However, an example in which the intermetallic compound is formed of copper-tin will hereinafter be described for convenience of explanation.

The intermetallic compound 150 may be disposed in a form of a plurality of islands on the distal end of the first lead portion 121*a* of the coil 120.

In addition, the plurality of islands may have a layer form.

The base resin 131*c* may include a thermosetting resin having an electrical insulating property.

In this case, the thermosetting resin may be, for example, an epoxy resin. However, the thermosetting resin according to the present disclosure is not limited thereto.

The base resin 131*c* may serve to mechanically bond the distal end of the first lead portion 121*a* of the coil 120 and the electrode layer 132 to each other.

The conductive resin layer 131 according to the present exemplary embodiment may include a connection part formed on the third surface 3 of the body 110 and a band part extended from the connection part to portions of the first and second surfaces 1 and 2 of the body 110.

As illustrated in FIG. 3, in the conductive resin layer 131, when a thickness of a central portion of the connection part is t1, a thickness of a corner portion is t2, and a thickness of a central portion of the band part is t3, $t2/t1 \geq 0.05$, and $t3/t1 \leq 0.5$.

In a case in which t2/t1 is less than 0.05, the possibility that a crack will be generated in a corner portion of the body of the inductor may be increased, thus defects such as a short-circuit, a moisture resistance defect and the like, may be generated.

In a case in which t3/t1 exceeds 0.5, the band part of the external electrode may have an excessively rounded shape, such that it is difficult to use a jig at the time of mounting the inductor on a board, and a phenomenon in which the inductor topples over after it is mounted on the board may be generated.

Therefore, a mounting defective rate of the inductor may be increased.

In addition, a thickness of the external electrode may be increased, such that unit inductance of the inductor may be decreased.

The electrode layer may be a plating layer.

In this case, the electrode layer may have a structure in which a nickel plating layer 132 and a tin plating layer 133 are sequentially stacked, as an example.

In this case, the nickel plating layer 132 may contact the conductive connecting part 131*b* and the base resin 131*c* of the conductive resin layer 131.

Mechanism of Forming Conductive Resin Layer

Figure 7:
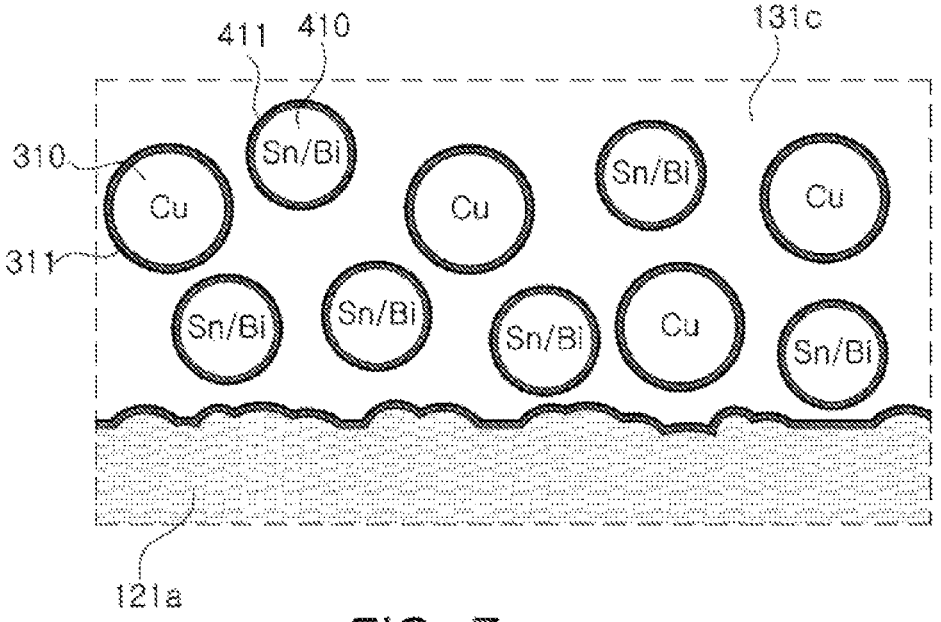
FIG. 7 is a view illustrating a state in which copper particles and tin-bismuth particles are dispersed in epoxy.
Figure 8:
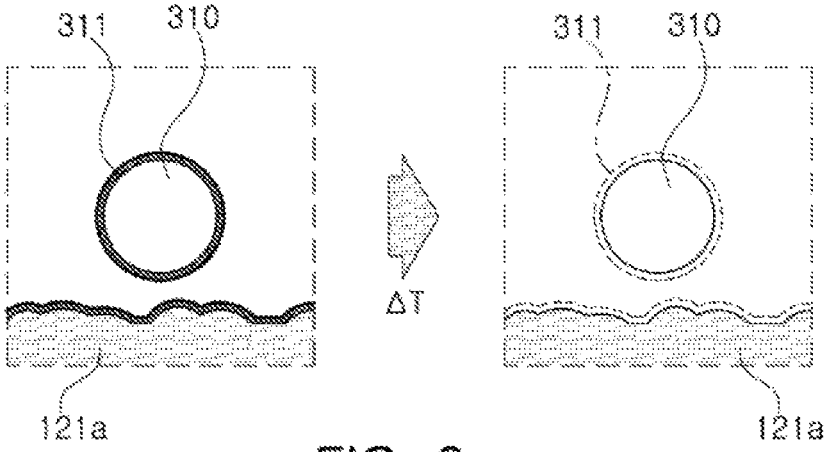
FIG. 8 is a view illustrating a state in which an oxide film of a copper particle is removed by an oxide film remover or heat.
Figure 9:
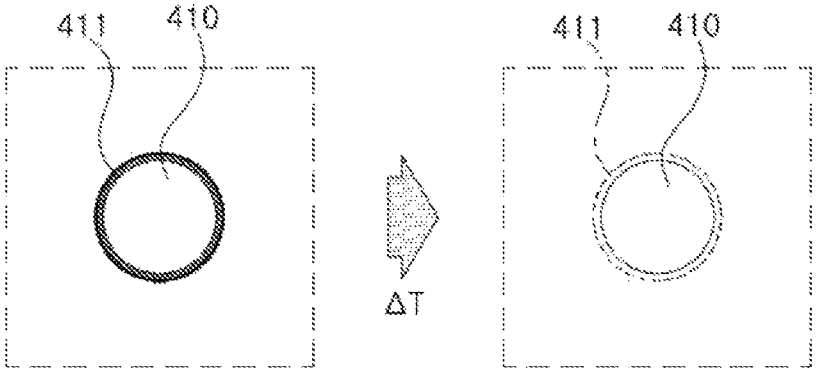
FIG. 9 is a view illustrating a state in which an oxide film of a tin/bismuth particle is removed by an oxide film remover or heat.
Figure 10:
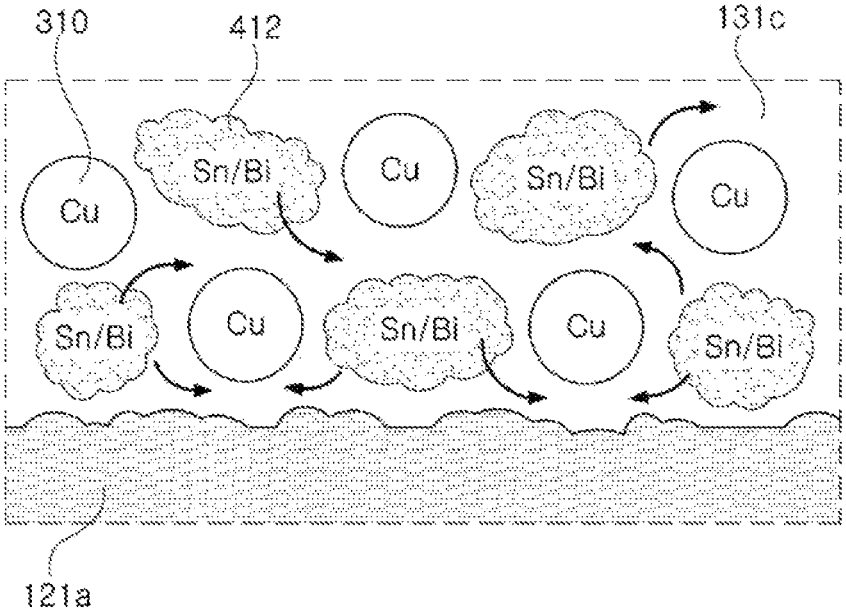
FIG. 10 is a view illustrating a state in which tin/bismuth particles are melted to have flowability.
Figure 11:
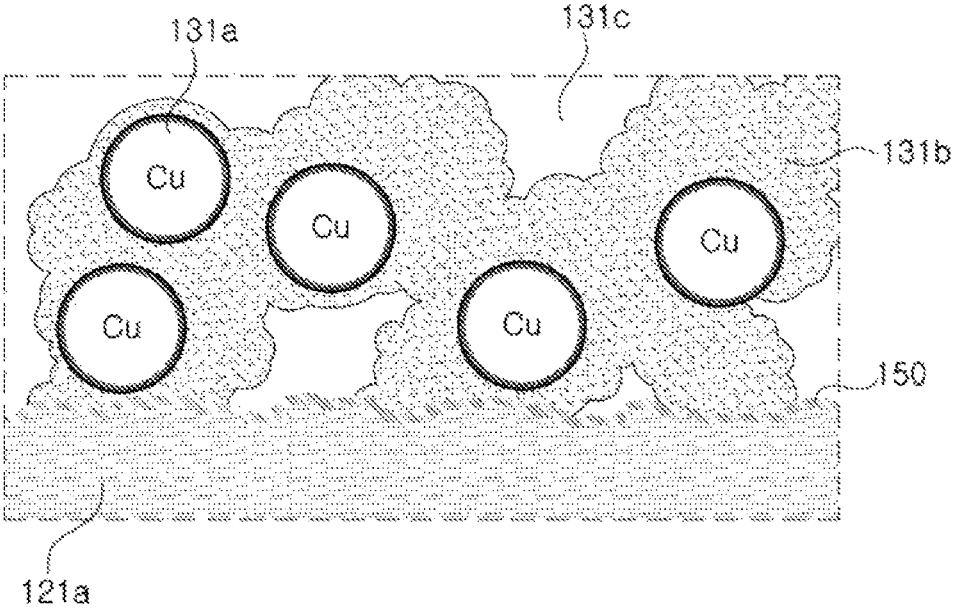
FIG. 11 is a view illustrating a state in which copper particles and tin/bismuth particles react to each other to form an intermetallic compound.

FIG. 7 is a view illustrating a state in which copper particles and tin-bismuth particles are dispersed in epoxy, FIG. 8 is a view illustrating a state in which an oxide film of a copper particle is removed by an oxide film remover or heat, FIG. 9 is a view illustrating a state in which an oxide film of a tin/bismuth particle is removed by an oxide film remover or heat, FIG. 10 is a view illustrating a state in which tin/bismuth particles are melted to have flowability, and FIG. 11 is a view illustrating a state in which copper particles and tin/bismuth particles react to each other to form a copper-tin layer.

A mechanism of forming the conductive resin layer 131 will hereinafter be described with reference to FIGS. 7 through 11.

Referring to FIGS. 7 through 9, copper particles 310, and tin/bismuth (Sn/Bi) particles 410 which are low melting point metal particles, included in the base resin 131*c*, may have oxide films 311 and 411 present on surfaces thereof, respectively.

In addition, the first lead portion 121*a* may also have an oxide layer present 1211*a* on a surface thereof.

The oxide films 311 and 411 may hinder a copper-tin layer from being formed by a reaction between the copper particles and the tin/bismuth particles, and may be removed by an oxide film remover included in epoxy or heat (ΔT) at the time of performing a hardening process or may be removed by acid solution processing, if necessary.

In this case, the oxide film 1211*a* of the first lead portion 121*a* may be removed together with the oxide films 311 and 411, as shown in the right portions of FIGS. 8 and 9.

The oxide film remover may be an acid, a base, hydrogen halide, or the like. However, the oxide film remover according to the present disclosure is not limited thereto.

Referring to FIG. 10, the tin/bismuth particles 410 from which the oxide films 411 are removed may start to be melted at about 140° C., and the melted tin/bismuth particles 410 may have flowability, move toward the copper particles 310 from which the oxide films 311 are removed, and react to the copper particles 310 at a predetermined temperature to form the conductive connecting part 131*b*, and then move toward the first lead portion 121*a* to form the intermetallic compound 150, which is a copper-tin layer, as illustrated in FIG. 11.

The intermetallic compound 150 formed as described above may be connected to the conductive connecting part 131*b* of the conductive resin layer 131, formed of copper-tin to decrease contact resistance between the first lead portion 121*a* and the conductive resin layer 131.

The copper particles 131*a* illustrated in FIG. 11 indicate copper particles present in the conductive connecting part 131*b* after the reaction described above.

In this case, surface oxidation may be easily generated in the tin/bismuth particles 410. In this case, the surface oxidation may hinder the intermetallic compound 150 from being formed.

Therefore, the tin/bismuth particles 410 may be surface-treated so that a content of carbon is 0.5 to 1.0 wt % in order to prevent the surface oxidation.

Meanwhile, Sn/Bi is used as a low melting point metal particle in the present exemplary embodiment. Alternatively, at least one of Sn—Pb, Sn—Cu, Sn—Ag, and Sn—Ag—Cu, may be used as the low melting point metal particle, if necessary.

In this case, a disposition of an intermetallic compound 150 on the distal end of the first lead portion 121*a* of the coil 120 may be determined depending on sizes, contents, compositions and the like, of the copper particles 310 and the tin/bismuth particles 410.

In addition, in the present mechanism, a melting temperature of the tin-bismuth particles and a forming temperature of the intermetallic compound need to be lower than a hardening temperature of the epoxy resin, which is the base resin.

When the melting temperature of the tin-bismuth particles and the forming temperature of the intermetallic compound are higher than the hardening temperature of the epoxy resin, the base resin may be hardened first, such that the melted tin-bismuth particles may not move to the surfaces of the copper particles, and thus the copper-tin layer, which is the intermetallic compound, may not be formed.

In addition, a content of the tin-bismuth particles for forming the intermetallic compound may be 20 to 80 wt % with respect to the total weight of metal particles.

When the content of the tin-bismuth particles is less than 20 wt %, all of the added tin-bismuth particles are consumed in a reaction to the metal particles in the conductive resin layer 131, such that it may be difficult to dispose the conductive connecting part on the first lead portion 121*a*.

In addition, when the content of the tin-bismuth particles exceeds 80 wt %, the tin-bismuth particles remaining after forming the conductive connecting part may protrude outwardly of the conductive resin layer 131.

In addition, a content of tin in the tin-bismuth particles needs to be appropriately adjusted. In the present exemplary embodiment, a component reacting to the copper particles to form the intermetallic compound may be tin, and thus, a content (x) of Sn in $Sn_x$—$Bi_y$ may be 40 wt % or more with respect to total metal particles, in order to secure a predetermined level or more of reactivity. When the content (x) of Sn is less than 40 wt % with respect to the total metal particles, Rdc of the manufactured inductor may be increased.

In addition, the intermetallic compound 150 may include one or more of copper-tin, silver-tin, and nickel-tin. In this case, 10 volume % or less of metal particles may be further included in the intermetallic compound 150, and 10 volume % or less of bismuth (bi) may be further included in intermetallic compound 150.

The metal particles may include at least one selected from the group consisting of copper, silver, nickel, and copper coated with silver.

Table 1 represents Rdc and a change in reliability of an inductor according to a change in a composition of an intermetallic compound.

Here, it is decided that samples in which a measured value of Rdc is 40 mΩ or more, or a change rate in Rdc before and after samples are dipped in lead melted at 260° C. or more is 10% or more, are defective.

In the present experimental example, an intermetallic compound includes copper-tin, and a metal particle is a copper particle.

TABLE 1

| # | Cu [wt %] | SnBi [wt %] | Rdc [mΩ] | Rdc after Lead Heat Resistance Test [mΩ] | Whether or not Solder Protrudes |
|---|---|---|---|---|---|
| 1 | 90 | 10 | 42.1 | 62.8 | No |
| 2 | 85 | 15 | 38.2 | 56.2 | No |
| 3 | 80 | 20 | 37.5 | 37.7 | No |
| 4 | 70 | 30 | 37.3 | 37.1 | No |
| 5 | 60 | 40 | 36.2 | 35.1 | No |
| 6 | 50 | 50 | 36.5 | 34.2 | No |
| 7 | 40 | 60 | 37.6 | 35.4 | No |
| 8 | 30 | 70 | 38.3 | 38.1 | No |
| 9 | 20 | 80 | 38.8 | 39.2 | No |
| 10 | 10 | 90 | 42.1 | 42.5 | Yes |
| 11 | 0 | 100 | 56.4 | 56.2 | Yes |

Referring to Table 1, in a case in which 15 wt % of SnBi is added, as in Sample 2, Rdc was measured to be 38.2 mΩ, but a conductive connecting part was not appropriately formed on a contact surface between an external electrode and an internal electrode, such that Rdc was increased to 56.2 mΩ after Sample 2 was dipped into a lead bath of 260° C.

To the contrary, in a case in which 90 wt % or more of SnBi is added as in Samples 10 and 11, Cu particles, which are conductive particles forming a pillar, were insufficient or were not present, such that low melting point metals were aggregated, such that an interval between particles in an external electrode was increased, and thus Rdc was increased.

In addition, in this case, an excessive amount of SnBi, which is the low melting point metal, was added, such that the remaining SnBi that did not participate in a reaction for forming the intermetallic compound protruded to a surface of an electrode.

Therefore, it may be appreciated that Rdc and reliability for interface connectivity are good in a case in which a content of SnBi, which is the low melting point metal, in the external electrode is 20 to 80 wt %.

In general, when a conductive resin layer is used in an external electrode of an inductor, Rdc is affected by all of several kinds of resistance components applied to the external electrode.

These resistance components include resistance of a coil, contact resistance between the conductive resin layer and the coil, resistance of the conductive resin layer, contact resistance between an electrode layer and the conductive resin layer, and resistance of the electrode layer.

Here, the resistance of the coil and the resistance of the electrode layer, which are fixed values, are not varied.

In addition, in an Inventive Example, an intermetallic compound may be disposed on a distal end of a lead portion of a coil, the intermetallic compound may contact a conductive connecting part of a conductive resin layer of an external electrode, and the conductive connecting part may contact a plurality of metal particles included in the conductive resin layer and an electrode layer disposed on the conductive resin layer.

Therefore, a stress decrease effect in the body and an improvement effect of high temperature load and moisture resistance load characteristics, due to the conductive resin layer, may be maintained, and a contact defect between the coil and the external electrode may be prevented due to high electric conductivity of the conductive resin layer, such that reliability of the inductor may be improved and Rdc of the inductor may be decreased.

As an example, Rdc of an inductor in which the intermetallic compound is not present in the conductive resin layer is 37 mΩ, while Rdc of an inductor, according to an Inventive Example in which the intermetallic compound is disposed in the conductive resin layer, may be decreased to 34 mΩ.

In an Inventive Example, copper particles, tin/bismuth particles, an oxide film remover, and 4 to 15 wt % of epoxy resin were mixed with one another, depending on the above-mentioned condition, and were dispersed using a 3-roll-mill to prepare a conductive resin, and the conductive resin was applied onto third and fourth surfaces of a body to form external electrodes.

According to an Inventive Example, intermetallic compounds of conductive resin layers of the external electrodes are disposed on first and second lead portions of a coil, conductive connecting parts are formed in base resins to contact the intermetallic compounds to form current channels, and the conductive connecting parts are configured to surround a plurality of metal particles in a melted state and contact electrode layers to decrease resistance of the conductive resin layers and decrease contact resistance between the conductive resin layers and the lead portions and contact resistance between the electrode layers and the conductive resin layers, such that Rdc of the inductor may be significantly decreased.

In addition, when the conductive connecting part is formed of a low melting point metal having high conductivity, conductivity of the conductive resin layer is further improved, such that resistance of the conductive resin layer may be further decreased, and thus Rdc of the inductor may be further decreased.

In addition, the bonding force of the first external electrode 130 may be increased by the intermetallic compound 150, such that warpage strength of the multilayer inductor may be improved.

The intermetallic compound 150 may be formed to have an area greater than or equal to 30% of a total contact area between the first lead portion 121*a* and the conductive resin layer 131.

In a case in which the intermetallic compound 150 is formed to have an area less than 30% of the area in which the first lead portion 121*a* and the conductive resin layer 131 contact each other, the Rdc of the inductor exceeds 28.5 mΩ, such that an Rdc decrease effect may not be appropriately implemented.

In the present exemplary embodiment, a pass/fail reference of Rdc of the coil component is 28.5 mΩ.

This numerical value is an average Rdc value in a case in which the conductive resin layer is formed of Cu-epoxy without using the intermetallic compound. Here, in a case in which the intermetallic compound 150 is formed to have an area equal to or greater than 60% of the area in which the first lead portion 121*a* and the conductive resin layer 131 contact each other, an Rdc decrease effect may be significantly improved.

Table 2 represents a result of a lead heat resistance test performed on samples including an external electrode including a conductive resin layer formed of Cu-epoxy without using an intermetallic compound. Referring to Table 2, a change rate in Rdc of 10% or more was generated in two (Samples 4 and 6) of ten samples as a result of the lead heat resistance test.

TABLE 2

| # | Rdc (5 mΩ) before Lead Heat Resistance Test | Rdc (5 mΩ) after Lead Heat Test Resistance Test for Ten Seconds | Change Rate (%) in Rdc |
|---|---|---|---|
| 1 | 37.6 | 35.4 | −5.85 |
| 2 | 38.4 | 38.6 | 0.52 |
| 3 | 38.6 | 38.4 | −0.52 |
| 4 | 38.5 | 43.6 | 13.25 |
| 5 | 38.7 | 35.4 | −8.53 |
| 6 | 31.7 | 38.8 | 22.40 |
| 7 | 38.7 | 35.8 | −7.49 |
| 8 | 41.2 | 37.1 | −9.95 |
| 9 | 37.0 | 37.4 | 1.08 |
| 10 | 36.6 | 36.3 | −0.82 |

On the other hand, in a case in which an intermetallic compound is formed to have an area equal to or greater than 5% of a total contact area between a lead portion and a conductive resin layer, change rates in Rdc in all of the Samples were not large at the time of performing a lead heat resistance test for ten seconds at 270° C.

However, in a severe condition, in which a lead heat resistance test is performed for thirty seconds at 340° C., in a case in which an intermetallic compound is formed to have an area corresponding to 30 to 60% of a total contact area between a lead portion and a conductive resin layer, samples in which a change rate in Rdc is 10% or more were generated at a probability of 1/20, and in a case in which an intermetallic compound is formed to have an area corresponding to 60 to 99.9% of a total contact area between a lead portion and a conductive resin layer, change rates in Rdc in all of Samples were less than 10%, even in the severe condition.

Figure 12A:
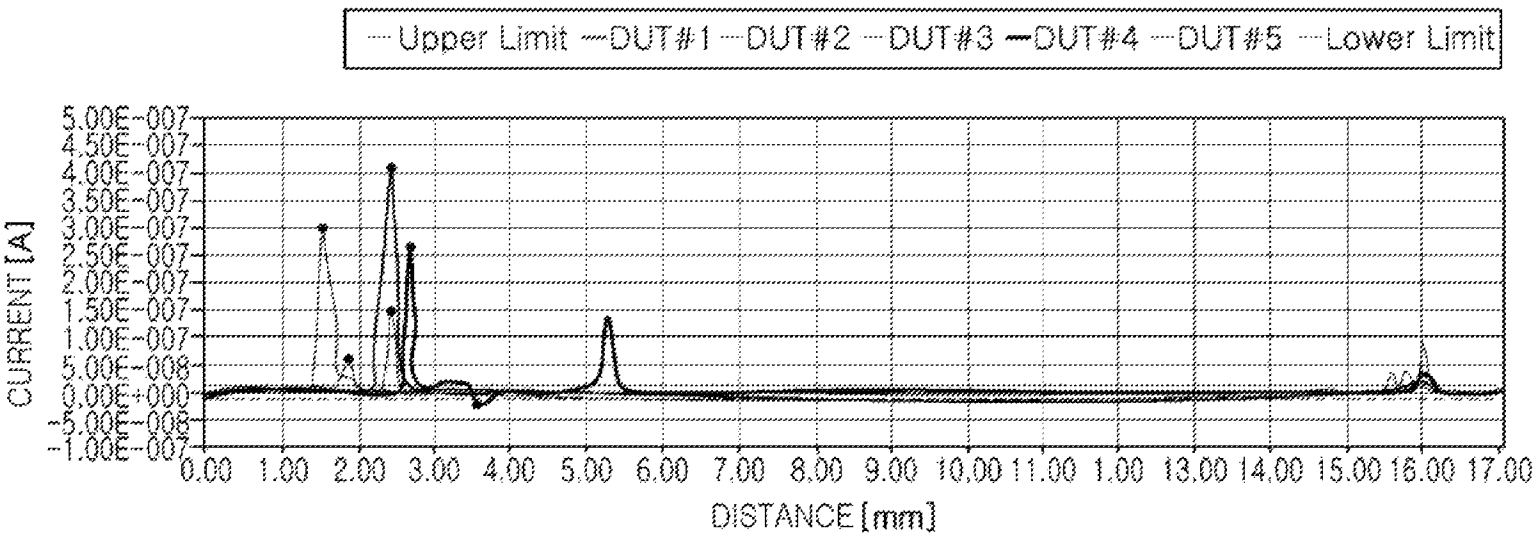
FIG. 12A is a graph illustrating warpage strength of a multilayer inductor in which an external electrode including a conductive resin layer that does not have an intermetallic compound is used.
Figure 12B:
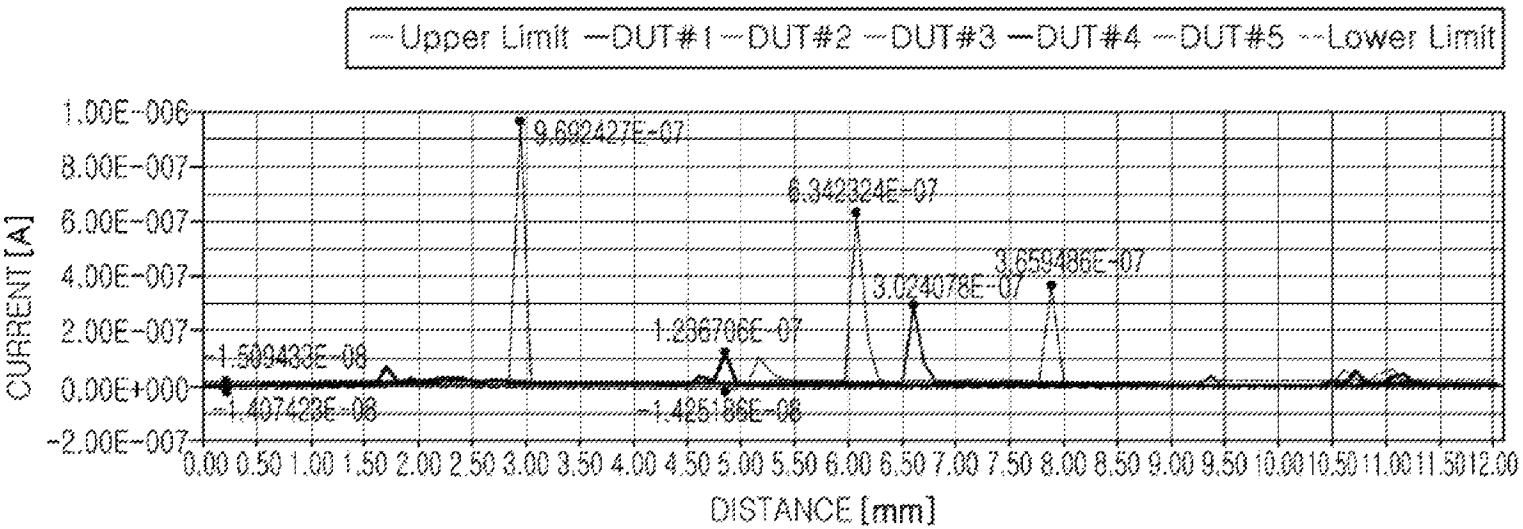
FIG. 12B is a graph illustrating warpage strength of a multilayer inductor according to an Inventive Example in which an external electrode including a conductive resin layer that has an Ag—Sn layer, which is an intermetallic compound, is used.

FIG. 12A is a graph illustrating warpage strength of a multilayer inductor according to a Comparative Example in which an external electrode, including a conductive resin layer formed of Cu-epoxy without using an intermetallic compound, is used, and FIG. 12B is a graph illustrating warpage strength of a multilayer inductor according to an Inventive Example in which an external electrode, including a conductive resin layer that has an Ag—Sn layer, which is an intermetallic compound, is used.

A method of measuring warpage strength is as follows.

A chip is mounted on a printed circuit board (PCB) to be directed downwardly, and is gradually pressed.

In this case, a level at which the PCB is bent is represented by a bending depth (mm), while a survival rate (%) is determined through a change in a physical measured value (mm at which a change value arrives at an NG range in ten measurements is decided).

Here, a sample in which a change is not generated, even though the bending depth is increased, has excellent characteristics.

FIGS. 12A and 12B illustrate raw data immediately before the survival rate (%) is derived as described above.

Referring to FIGS. 12A and 12B, it may be confirmed that warpage strength of the inductor according to an Inventive Example is significantly improved as compared to a Comparative Example.

Therefore, it may be appreciated that, in a case in which the intermetallic compound 150 is formed to have an area equal to or greater than 30% of the total contact area between the first lead portion 121*a* and the conductive resin layer 131, a change rate in Rdc is not decided to be defective in the lead heat resistance test, and a defect of warpage strength does not appear, such that the change rate in Rdc and the warpage strength are excellent.

In addition, it may be appreciated that, in a case in which the intermetallic compound 150 is formed to have an area equal to or greater than 60% of the total contact area between the first lead portion 121*a* and the conductive resin layer 131, a change rate in Rdc is further improved.

Table 3 represents a relationship between a thickness of an intermetallic compound and a change rate in Rdc. A lead heat resistance test was performed on ten chips in each sample, and the number of samples in which a defect is generated was stated. The lead heat resistance test was performed by the same method as that of Table 2.

Here, a change rate in Rdc before and after fall is obtained by measuring initial Rdc after a chip is mounted on a PCB and again measuring Rdc after free fall is performed on the PCB, in which the chip is mounted from a height of 1 m to a concrete floor ten times, and bonding strength of an external electrode may be measured using the fact that a change rate in Rdc [(latter value-initial value)/initial value*100] is increased when bonding strength is decreased.

In the present exemplary embodiment, a sample in which a change rate in Rdc is 10% or more is decided to be defective.

TABLE 3

| # | Thickness (μm) of Intermetallic Compound | Number (EA) of Chips Decided to be Defective Depending on Change Rate in Rdc in Lead Heat Resistance Test | Number (EA) of Chips Decided to be Defective Depending on Change Rate in Rdc before and after Fall |
|---|---|---|---|
| 1 | 0.5 | 2/10 | 2/10 |
| 2 | 2.0 | 0/10 | 0/10 |
| 3 | 3.5 | 0/10 | 0/10 |

TABLE 3-continued

| # | Thickness (μm) of Intermetallic Compound | Number (EA) of Chips Decided to be Defective Depending on Change Rate in Rdc in Lead Heat Resistance Test | Number (EA) of Chips Decided to be Defective Depending on Change Rate in Rdc before and after Fall |
|---|---|---|---|
| 4 | 5.0 | 0/10 | 0/10 |
| 5 | 12 | 5/10 | 5/10 |

Referring to Table 3, in Sample 1, in which a thickness of an intermetallic compound is less than 2.0 μm, chips in which a change rate in Rdc becomes large, to 10% or more, were generated, and also in a case in which a thickness of an intermetallic compound is excessively thick (Sample 5), chips in which a change rate in Rdc becomes large were generated.

However, in Samples 2 to 4 in which a thickness of an intermetallic compound is 2 to 5 μm, defects depending on change rates in Rdc were not generated in chips in a lead heat resistance test performed for thirty seconds at 340° C., as well as a lead heat resistance test performed for ten seconds at 270° C. Therefore, it may be appreciated that a thickness of an intermetallic compound in chips in which the defects depending on change rates in Rdc are not generated is 2 to 5 μm.

MODIFIED EXAMPLE

Figure 13:
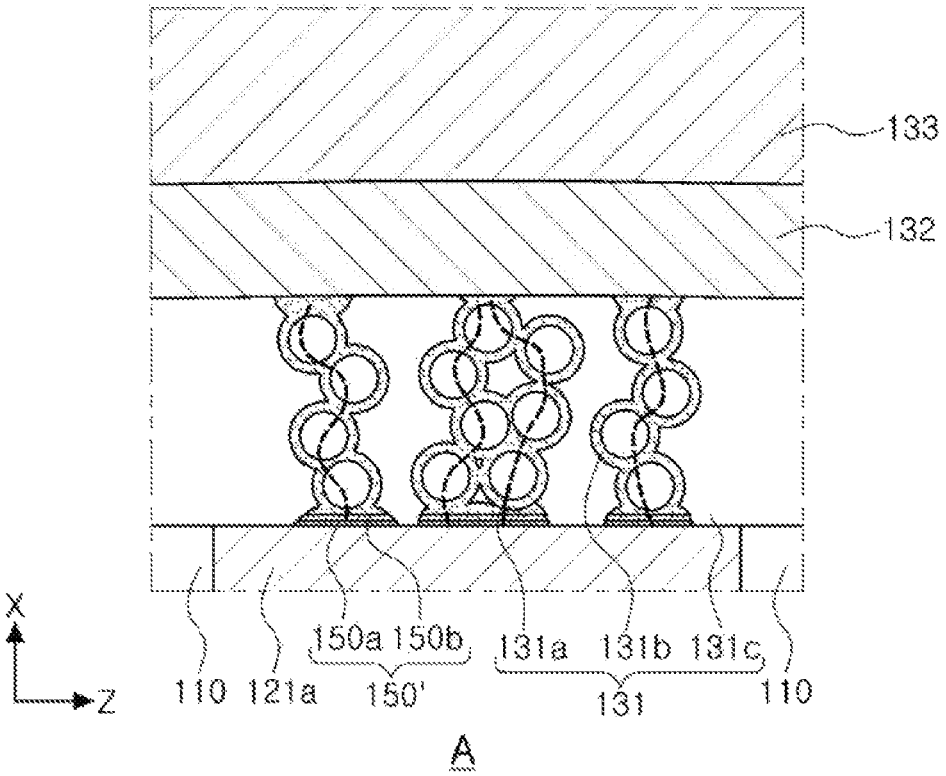
FIG. 13 is a cross-sectional view illustrating an intermetallic compound formed of double layers.
Figure 14:
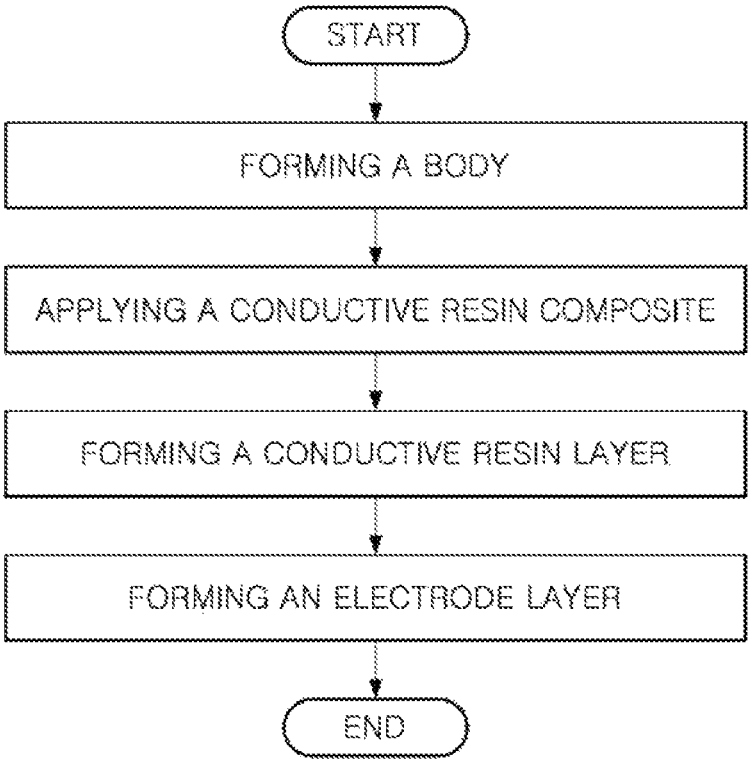
FIG. 14 is a flow chart illustrating a method of manufacturing a coil component.

FIG. 13 is a photograph illustrating an intermetallic compound formed of double layers.

Referring to FIG. 13, an intermetallic compound 150' according to the present exemplary embodiment may be formed of two layers.

In addition, a first layer 150*a* positioned adjacent to the lead portion 121*a* may be formed of $Cu_3Sn$, in which a content of copper is relatively large, and a second layer 150*b* positioned adjacent to the electrode layer 132 may be formed of $Cu_6Sn_5$, in which a content of Sn is relatively large.

In addition, the lead portion 121*a* may include copper, and the conductive connecting part 131*b* of the conductive resin layer 131 of the external electrode may be formed of $Ag_3Sn$.

Method of Manufacturing Multilayer Inductor

A method of manufacturing a multilayer inductor according to an exemplary embodiment in the present disclosure will hereinafter be described in detail, but the present disclosure is not limited thereto, and a description of contents overlapping the contents of the multilayer inductor described above in a description for a method of manufacturing a multilayer inductor according to the present exemplary embodiment will be omitted.

In the method of manufacturing a multilayer inductor according to the present exemplary embodiment, a plurality of ceramic green sheets formed of a material including a magnetic material may be prepared first.

Then, conductor patterns may be formed on the respective sheets.

In this case, the conductor pattern may be formed in a shape as similar as possible to a loop shape, along a circumference of the sheet. However, the conductor pattern according to the present disclosure is not limited thereto.

In addition, the conductor pattern may be formed of a material having excellent electrical conductivity, for example, a conductive material such as silver (Ag), copper (Cu), nickel (Ni), or alloys thereof. However, the conductor pattern according to the present disclosure is not limited thereto.

In addition, the conductor pattern may be formed by a general method such as one of a thin film printing method, an applying method, a depositing method, a sputtering method and the like. However, the conductor pattern according to the present disclosure is not limited thereto.

In this case, conductor patterns may be formed on two sheets to have lead portions led, respectively, through both end surfaces of the sheets.

Conductive vias may be formed in the respective sheets manufactured as described above.

The conductive vias may be formed by forming through-holes in the sheets and then filling a conductive paste in the through-holes.

The conductive paste may be formed of a material having excellent electrical conductivity, and may include any one of silver (Ag), silver-palladium (Ag—Pd), nickel (Ni), and copper (Cu), or alloys thereof. The conductive paste according to the present disclosure is not limited thereto.

Then, the plurality of sheets on which the conductor patterns are formed may be stacked between conductor patterns having first and second lead portions so that conductive vias formed in adjacent sheets contact each other, thereby forming a laminate so that a plurality of conductor patterns are electrically connected to one another to constitute one coil.

In this case, at least one upper or lower cover sheet may be stacked on, or a paste formed of the same material as that of the sheets constituting the laminate may be printed at, a predetermined thickness on an upper or lower surface of the laminate to form an upper or lower cover.

Then, the laminate may be fired to form a body.

Then, first and second external electrodes may be formed on both surfaces of the body in a length direction of the body, respectively, to be electrically connected to the first and second lead portions externally exposed, respectively.

To this end, a conductive resin composite including metal particles, a thermosetting resin, and a low melting point metal, having a melting point lower than that of the thermosetting resin, may be prepared.

The conductive resin composite may be prepared by mixing, for example, copper particles, which are the metal particles, tin/bismuth particles, which are the low melting point metal, an oxide film remover, and 4 to 15 wt % of epoxy resin, with one another and then dispersing them using a 3-roll mill.

Then, the conductive resin composite may be applied onto one surface of the body and then be dried and hardened to form an intermetallic compound and a conductive resin layer.

Here, in a case in which some of the metal particles do not completely react to the low melting point metal, such that they remain, the remaining metal particles may be present in the conductive resin layer in a state in which they are covered by the melted low melting point metal.

In addition, the metal particles may include at least one selected from the group consisting of nickel, silver, copper coated with silver, copper coated with tin, and copper. However, the metal particles according to the present disclosure are not limited thereto.

The thermosetting resin may include, for example, an epoxy resin. However, the thermosetting resin according to the present disclosure is not limited thereto, but may be, for example, a bisphenol A resin, a glycol epoxy resin, a novolak epoxy resin, or a resin that is in a liquid state in room temperature, due to a small molecular weight among derivatives thereof.

Further, the method of manufacturing a multilayer inductor according to the present exemplary embodiment may further include forming an electrode layer on the conductive resin layer.

The electrode layer may be formed by plating, and may include, for example, a nickel plating layer and a tin plating layer further formed on the nickel plating layer.

As set forth above, according to the exemplary embodiment in the present disclosure, the intermetallic compound is disposed on the distal end of the coil exposed through one surface of the body, the intermetallic compound is bonded to the conductive connecting part of the conductive resin layer of the external electrode, and the conductive connecting part is bonded to the plurality of metal particles included in the conductive resin layer, the intermetallic compound, and the electrode layer disposed on the conductive resin layer, to prevent a contact defect between the coil and the external electrode, such that reliability of the coil component may be improved and Rdc of the coil component may be decreased.

While exemplary embodiments have been shown and described above, it will be apparent to those skilled in the art that modifications and variations could be made without departing from the scope of the present invention as defined by the appended claims.

What is claimed is:

1. A coil component comprising:

a body including a coil, of which both ends are externally exposed;

intermetallic compounds disposed on the exposed both ends of the coil; and external electrodes disposed on the body to cover the intermetallic compounds, wherein the external electrodes include:

conductive resin layers disposed on outer surfaces of the body, to be bonded to the exposed both ends of the coil, and including base resins, a plurality of metal particles disposed in the base resins, and conductive connecting parts surrounding the plurality of metal particles and contacting the intermetallic compounds; and electrode layers disposed on the conductive resin layers and contacting the conductive connecting parts, wherein the intermetallic compounds are only disposed on the exposed both ends of the coil, and the conductive resin layers are directly in contact with the outer surfaces of the body and the exposed both ends of the coil.

2. The coil component of claim 1, wherein one of the conductive connecting parts contacting one of the intermetallic compounds continuously extends to contact one of the electrode layer.

3. The coil component of claim 1, wherein the conductive connecting parts and the intermetallic compounds include a common metal.

4. The coil component of claim 1, wherein the intermetallic compounds have a form of a plurality of islands.

5. The coil component of claim 4, wherein the plurality of islands have a layer form.

6. The coil component of claim 1, wherein the conductive connecting parts have a melting point lower than a hardening temperature of the base resins.

7. The coil component of claim 1, wherein a melting point of the conductive connecting parts is 300° C. or less.

8. The coil component of claim 1, wherein the intermetallic compounds are formed of one of copper-tin, silver-tin, and nickel-tin, and the metal particles of the conductive resin layers are formed of at least one selected from the group consisting of copper, nickel, silver, copper coated with silver, and copper coated with tin.

9. The coil component of claim 8, wherein the conductive connecting parts of the conductive resin layers include $Ag_3Sn$.

10. The coil component of claim 1, wherein the metal particles of the conductive resin layers are metal particles having spherical shapes, metal particles having flake shapes, or mixtures of metal particles having spherical shapes and metal particles having flake shapes.

11. The coil component of claim 1, wherein a content of one of copper-tin, silver-tin, and nickel-tin included in the intermetallic compounds is 30 to 70 volume %.

12. The coil component of claim 1, wherein the body includes first and second surfaces opposing each other, third and fourth surfaces opposing each other and connecting front ends of the first and second surfaces to each other, and fifth and sixth surfaces opposing each other, and connecting front ends of the first and second surfaces to each other and connecting front ends of the third and fourth surfaces to each other, the both ends of the coil are exposed through the third and fourth surfaces of the body, respectively, and the conductive resin layers are formed on the third and fourth surfaces of the body, respectively.

13. The coil component of claim 12, wherein the external electrodes include connection parts formed on the third and fourth surfaces of the body and band parts extended from the connection parts to portions of the first and second surfaces of the body, respectively.

14. The coil component of claim 13, wherein, in the conductive resin layer, when a thickness of a central portion of the connection part is t1, a thickness of a corner portion is t2, and a thickness of a central portion of the band part is t3, $t2/t1 \geq 0.05$ and $t3/t1 \leq 0.5$.

15. The coil component of claim 1, wherein the coil is formed of copper, and the intermetallic compounds are formed of copper-tin.

16. The coil component of claim 1, wherein the intermetallic compounds include 10 volume % or less of metal particles and 10 volume % or less of bismuth.

17. The coil component of claim 1, wherein a content of tin-bismuth (Sn—Bi) in all the metal in the conductive resin layers is 20 to 80 wt %.

18. The coil component of claim 1, wherein intermetallic compounds formed on one of the both ends of the coil have an area equal to or greater than 30% of a total contact area between the one end and one of the conductive resin layers contacting the one end.

19. The coil component of claim 1, wherein a thickness of the intermetallic compound is 2.0 to 5.0 μm.

20. The coil component of claim 1, wherein each intermetallic compound is formed of double layers, a layer positioned adjacent to one of the both ends is formed of $Cu_3Sn$, and a layer positioned adjacent to the one of the electrode layers is formed of $Cu_6Sn_5$.

21. A coil component comprising:

a body including a coil, of which both ends are externally exposed;

intermetallic compounds disposed on the exposed both ends of the coil; and external electrodes disposed on the body to cover the intermetallic compounds, wherein the external electrodes include:

conductive resin layers disposed on outer surfaces of the body to be bonded to the exposed both ends of the coil and including base resins and conductive connecting parts disposed in the base resins and contacting the intermetallic compounds; and electrode layers disposed on the conductive resin layers and contacting the conductive connecting parts, wherein the intermetallic compounds are only disposed on the exposed both ends of the coil, and the conductive resin layers are directly in contact with the outer surfaces of the body and the exposed both ends of the coil.

22. The coil component of claim 21, wherein one of the conductive connecting parts contacting one of the intermetallic compounds continuously extends to contact one of the electrode layer.

23. The coil component of claim 21, wherein the conductive connecting parts and the intermetallic compounds include a common metal.

* * * * *